United States Patent [19]

Ryan

[11] Patent Number: 4,614,226

[45] Date of Patent: Sep. 30, 1986

[54] VEHICLE HEATER REPAIR APPARATUS AND METHOD

[76] Inventor: Thomas W. Ryan, P.O. Box 6412, Orlando, Fla. 32853

[21] Appl. No.: 567,681

[22] Filed: Jan. 3, 1984

[51] Int. Cl.[4] ..... F28G 9/00

[52] U.S. Cl. ..... 165/76; 29/402.18; 123/41.14; 134/95; 134/103; 134/169 A; 165/95

[58] Field of Search ..... 29/157.3 R, 157.3 B, 29/157.3 A, 157.3 D, 157.3 C, 157.4, 402.14, 401.1, 402.18; 228/183; 137/15; 165/76, 95; 134/105-108, 169 A, 95, 103; 123/41.14

[56] References Cited

U.S. PATENT DOCUMENTS

| | | | |
|---|---|---|---|
| 3,115,145 | 12/1963 | Monteath, Jr. | 134/95 |
| 3,409,218 | 11/1968 | Moyer | 134/169 A |
| 4,176,708 | 12/1979 | Joffe | 134/169 A |
| 4,213,474 | 7/1980 | Harrison | 134/169 A |
| 4,390,049 | 6/1983 | Albertson | 134/169 A |

*Primary Examiner*—Sheldon J. Richter
*Attorney, Agent, or Firm*—Leonard Bloom

[57] ABSTRACT

A vehicle heater cleaning and repair apparatus and method is provided in which the apparatus has a closed loop pipe system removably connectable to a vehicle heater input and output line which have been disconnected from the engine under the vehicle hood. The water inlet is connected to a water source for allowing the injection of water into the pipe system. A valve allows the water to be shut on or off. A pump is connected to the pipe system for pumping liquid therethrough and through the vehicle heater. Sealant solution and cleaning solution tanks are connected to the piping system for first injecting a cleaning solution for circulation through the vehicle heater core and later for circulating a sealing solution. An electrical heater is also connected to the pipe system for heating the liquids being circulated by the pump through the vehicle heater core. The pipe system has a drain connection through a valve and through a pressure relief valve for dumping the water and cleaning solution and the sealant solution after the cleaning and sealing has been completed. The cleaning solution tank and the sealing solution tank are connected to a source of air for applying the solutions under pressure into the piping system. A repair method allows the vehicle heater to be cleaned and sealed without removal from the vehicle.

10 Claims, 1 Drawing Figure

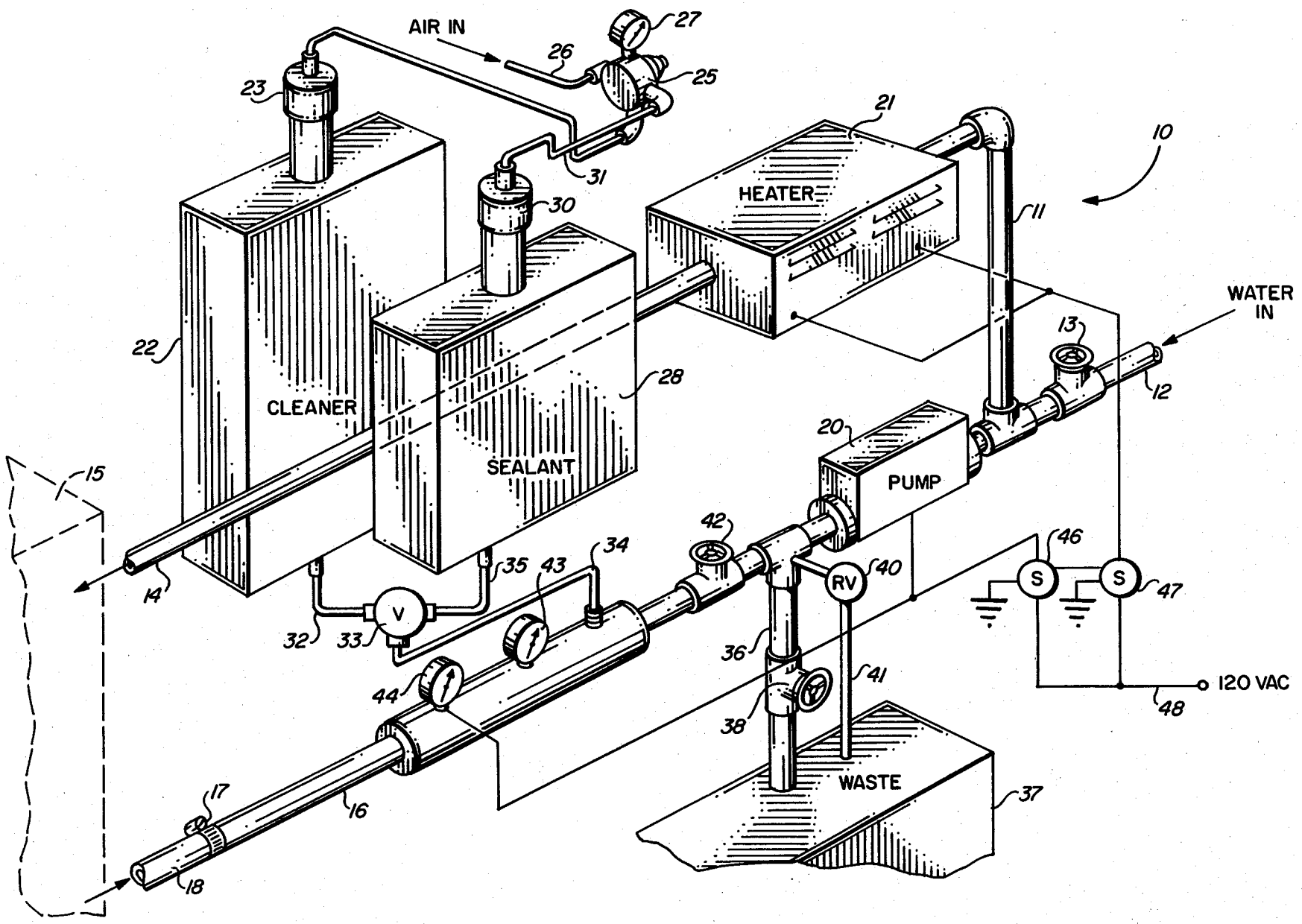
WATER IN
120 VAC
HEATER
PUMP
WASTE
SEALANT
CLEANER
AIR IN
RV
S
S
V
10
11
12
13
14
15
16
17
18
20
21
22
23
25
26
27
28
30
31
32
33
34
35
36
37
38
40
41
42
43
44
46
47
48

VEHICLE HEATER REPAIR APPARATUS AND METHOD

BACKGROUND OF THE INVENTION

The present invention relates to an apparatus for cleaning and sealing a vehicle heater and especially to an apparatus for cleaning and sealing a vehicle heater without removing the heater from the vehicle.

Most vehicles today are sold with heaters for heating passenger compartments or cabs and these typically have a heat exchanger core mounted inside the passenger compartment and connected through liquid pipes to the vehicle engine cooling system for circulating the heated coolant through the heat exchanger. The heat exchanger includes a blower for removing the heat from the heat exchanger core and blowing it into the passenger compartment. It may include various types of thermostatic controls for monitoring the temperature in the passenger compartment. Vehicle heaters are connected through the vehicle fire wall between the passenger compartment and the engine compartment and has flexible high pressure and temperature hoses, including an inlet hose for directing liquid from the engine coolant system through the heat exchanger core of the vehicle heater and an output line for directing circulating fluid back into the engine coolant system. The flow through the heater is generated by the engine water pump which pumps the coolant, which is typically a mixture of water and a coolant solution, for cooling the engine. Cooling systems in internal combustion engines may require a variety of repairs, such as replacing a thermostat which maintains the temperature of the coolant solution in the engine at a predetermined level and replacing the water pump which circulates the coolant solution. If an engine radiator core develops leaks, the core can be readily gotten to, removed from the engine and soldered or the entire core may be resoldered and then replaced on the engine. Leaks in vehicle heaters which are located in the passenger compartment are more difficult to remove from the vehicle and repair and thus becomes a very expensive item to repair if leaks develop in the heater core. In addition, the leaks release the coolant solution into the passenger compartment, which can do damage to the inside of the passenger compartment. Very minor leaks in the coolant system can be repaired by the feeding of sealant solutions which can be purchased and added to the coolant solution to seal leaks. However, these operate on only very minor leaks since a proper repair requires that the inside of the pipes and soldering joints be thoroughly cleaned and resoldered or resealed at a higher temperature level.

It has been known in the past to provide various systems for cleaning the entire cooling system of a vehicle by connecting pipes at some connecting point to the coolant system and flushing cleaning solutions through the entire coolant system. However, the present invention is adapted specifically for the cleaning and repair of heater cores in a rapid manner without having to remove the heater core from the vehicle and is provided in one compact unit on wheels having flexible water and liquid lines connected thereto.

SUMMARY OF THE INVENTION

A vehicle heater cleaning and sealing apparatus is provided which includes a piping system for interconnecting the components of the repair apparatus and for connecting the apparatus to a vehicle heater without removing the heater from the vehicle. The piping system includes connecting means for removably connecting the vehicle heater input and output lines to the piping means. The piping means has a water inlet connected thereto through a valve so that water may be fed to the repair apparatus and then the water can be cut off and circulated by itself or with cleaning or sealant solutions added thereto. A pump is operatively connected to the piping system for pumping a liquid through the piping system and through the vehicle heater. The cleaning solution and sealing solution tanks are both connected to the piping system through a valve so that cleaning or sealing solution can be added to the piping system for circulation through the vehicle heater core. The cleaning solution tank and the sealing solution tank are each connected to an air line so that they are placed under pressure for injecting into the piping system under pressure. An electric heater is connected in the piping system for heating water, cleaning or sealant solutions being circulated through the piping system and through the vehicle heater by the pump. The piping system is also connected to a waste tank through a pressure relief valve and through a manually operated valve for discharging the waste from cleaning and sealing the vehicle heater. A temperature gauge can be connected to disengage the heater at predetermined temperatures and pressure gauges can be used to monitor pressure in the system. A method of cleaning and repairing a vehicle heater includes the steps of disconnecting the vehicle coolant line and connecting the repair apparatus, then injecting water and/or clenaing solutions into the apparatus prior to heating the liquid and cleaning the heater core. The process includes dumping the cleaning solution to a drain, then adding a sealant solution and sealing the heater core.

BRIEF DESCRIPTION OF THE DRAWINGS

Other objects, features and advantages of the present invention will be apparent from the written description and the drawing in which a perspective view is shown of a vehicle heater cleaning and repair apparatus.

DESCRIPTION OF THE PREFERRED EMBODIMENTS

Referring to the drawing, a vehicle heater cleaning and repair apparatus 10 has a piping system 11 having an inlet water pipe 12 connected thereto through a valve 13. The piping system 11 is connected to an inlet line 14 for a vehicle heater located behind a fire wall 15 of a vehicle engine compartment. Pipe 16 is removably connected with a clamp 17 to the outlet pipe 18 of a vehicle heater located in the vehicle passenger compartment. The piping system includes an electrically operated pump 20 for pumping liquid through the pipe 11 and through the vehicle heater and an electrically operated heater 21 for electrically heating through resistance heaters the liquid being pumped by the pump 20 through the piping system 11. A cleaning tank 22 holds a cleaning fluid for cleaning the vehicle heater pipes and heat exchanger and has a pressure cap 23 for adding cleaning solution thereto. A pipe 24 is connected through the top of cap 23 from a preset air pressure valve 25, which in turn is connected to an air pressure line 26 and has an air pressure gauge 27 attached thereto. A sealant solution tank 28 has an air pressure cap 30 for inserting a sealant solution that has an air pressure pipe 31 connected thereto and connected to the pressure valve 25 and to the air line 26. The cleaning solution tank 22 has an outlet line 32 connected to a three way valve 33, which is connected to a line 34 connected to the piping system 11 while the sealant solution tank 28 is connected through a line 35 through the three way valve 33 to the line 34 and into the pipe system 11. Thus, the valve 33 will allow either the cleaning solution or to the sealing solution to be injected into the piping system 11, but will allow only one to be opened at one time and since both tanks 22 and 28 are under air pressure from the air pressure line 26, which will force the solution into the pipe line 11 which may be under pressure from the pump 20. The injected solution is circulated by the pump 20 through the heater 21, through the line 14 into the vehicle heater, out the vehicle heater through the line 18 and 16 in a continuous closed loop circulation, first during cleaning and then during the sealing of the vehicle heater core.

Once the cleaning is complete, a drain line 36 is connected to a waste container 37 and allows the liquid in the system to be diverted thereinto when the valve 38 is opened. In the event the pressure set for the system is exceeding, an auto pressure relief valve 40 is connected through a pipe line 41 to the waste container 37. The system also has a manually operated valve 42 therein. A pressure gauge 43 is connected to the piping system 11 to monitor the pressure, while a temperature gauge 44 monitors the temperature within the circulating pipe system 11 and is connected through an electrical conductor 45, which is connected to an electrical switch 46 which also is connected to the pump 20.

A second relay switch 47 is connected to the heater 21 and may be set for actuation in the event of a short in the circuit line. Temperature gauge 44 uses an electrical sensor placed in the system for measuring the temperature of a liquid therein and thus needs power for the operation of the temperature sensor.

In operation, the entire cleaning and repair apparatus 10 is mounted upon one frame on rollers so that it can be rolled up to a vehicle and the lines connected to the heater inlet and outlet lines. The frame has an air connection 26 and a water connection 12 and a cleaning solution is inserted through the pressure cap 23 into the cleaning tank 22. The sealant solution is put into the sealant tank 28 through the pressure cap 30. Water is allowed to enter through the pipe 12 through the valve 13 to flow through the system and once the system is filled, the valve 13 can be cut off and the pump 20 actuated to circulate the liquid through the piping system 11 and through the vehicle heater core. The water can be heated by the heater 21 and the hot water, or even steam, can then be used to clean the vehicle heater core. A cleaning solution from the tank 22 is then added through the valve 33 to the liquid solution and the heated cleaning solution is circulated through the vehicle heater core to clean the heater core and the soldering joints therein.

The cleaning solution can be an acid solution such as diluted muratic acid. Once the vehicle heater core is cleaned, the cleaning solution can be dumped in the drain 37 and additional water injected into the system for adding sealant from the sealant tank 28, which can be heated and circulated through the vehicle heater core to seal all the joints and any leaks that might have developed in the vehicle heater heat exchanger core. Once this is completed, the sealant solution can be dumped into the waste container 37. The vehicle heater cleaning and repair apparatus 10 can then be disconnected from the heater input and output lines and the vehicle heater input and output lines reconnected to the engine cooling system, which can be refilled with coolant. The heater 21 and the pump 20 are electrically operated on a standard 120-volt line 48 through the relay switches 46 and 47. Conductor 48 can be a flexible conductor that allows the apparatus to be moved up next to a vehicle at a filling station or a garage. Similarly, the water inlet line 12 can be a flexible line and the air inlet line 26 can be a flexible line to allow limited movement of the entire system for placement adjacent a vehicle.

It will be clear at this point that a system for cleaning and sealing a vehicle heater without removing the vehicle heater from the vehicle has been provided. It should, however, be clear that the present invention is not to be considered as limited to the forms shown, which are to be considered illustrative rather than restrictive.

I claim:

1. A vehicle heater repair apparatus comprising:

a heater repair apparatus pipe system;

connecting means for removably connecting a vehicle heater input and output lines to said pipe system;

a water inlet connecting a water source to said pipe system for directing water into said pipe system;

a valve in said pipe system for opening and closing said water inlet thereinto;

a pump operatively connected into said pipe system for pumping liquid therethrough;

a sealing solution tank containing a sealing solution connected to said pipe system for injecting a sealing solution thereinto for circulating a sealant solution in said pipe system and through a vehicle heater connected to said pipe system;

heating means connected to said pipe system for heating liquid being circulated by said pump through a vehicle heater connected to said pipe system; and a cleaning solution tank holding a cleaning solution is attached to said pipe system for injecting a cleaning solution thereinto for circulation through a vehicle heater, whereby a vehicle heater can be cleaned and sealed with a heated liquid without removing the heater from the vehicle.

2. A vehicle heater repair apparatus in accordance with claim 1, in which said cleaning solution tank and said sealing solution tank are connected through a multi-way valve to said pipe system, whereby said cleaning solution and said sealing solution can only be fed separately into said pipe system.

3. A vehicle heater repair apparatus in accordance with claim 2, in which said cleaning solution tank and said sealing solution tank are connected to an air pressure line for applying air pressure thereto, whereby said cleaning solution and sealing solution can be injected into said pipe system under pressure.

4. A vehicle heater repair apparatus in accordance with claim 3, in which said air line connected to said cleaning solution tank and sealing solution tank is connected through a pressure regulator valve for controlling the pressure of the air in the cleaning solution tank and sealing solution tank.

5. A vehicle heater repair apparatus in accordance with claim 4, including a drain line connected between said pipe system and the waste container and having a manually operated valve therein.

6. A vehicle heater repair apparatus in accordance with claim 5, in which a pressure relief line pressure relief valve are connected between said pipe system and said waste container.

7. A vehicle heater repair apparatus in accordance with claim 6, in which said pipe system has a temperature gauge mounted therein for measuring temperature in said pipe system.

8. A vehicle heater repair apparatus in accordance with claim 7, in which said pipe system includes a pressure gauge therein for measuring the pressure of a liquid therein.

9. A vehicle heater repair apparatus in accordance with claim 8, in which said heating means is an electrical heater, said electrical heater and said pump are connected to an electrical line through electrical switches for manual actuation thereof.

10. A vehicle heater repair apparatus in accordance with claim 9, in which electrical line is connected to said temperature gauge for electrically sensing liquid temperature in said pipe system.

* * * * *

UNITED STATES PATENT AND TRADEMARK OFFICE

CERTIFICATE OF CORRECTION

PATENT NO. : 4,614,226

DATED : September 30, 1986

INVENTOR(S) : Thomas W. Ryan

It is certified that error appears in the above-identified patent and that said Letters Patent is hereby corrected as shown below:

On the title page Attorney, Agent or Firm should read

-- William M. Hobby III --.

Signed and Sealed this

Twenty-third Day of December, 1986

*Attest:*

DONALD J. QUIGG

*Attesting Officer* *Commissioner of Patents and Trademarks*